US005135109A

United States Patent [19]

Vergara

[11] Patent Number: 5,135,109

[45] Date of Patent: Aug. 4, 1992

[54] REFRIGERATED PRODUCT TRANSPORTER DUCT

[76] Inventor: Alfredo M. Vergara, 1331 Lincoln Rd. #1201, Miami Beach, Fla. 33139

[21] Appl. No.: 617,676

[22] Filed: Nov. 26, 1990

[51] Int. Cl.[5] ..... B65D 19/00

[52] U.S. Cl. ..... 206/386; 206/503; 206/600; 220/913

[58] Field of Search ..... 220/913; 217/42, 40, 217/74, 125; 190/39; 206/386, 503, 600

[56] References Cited

U.S. PATENT DOCUMENTS

| | | | |
|---|---|---|---|
| 702,106 | 6/1902 | Lewis | 217/74 |
| 2,609,956 | 9/1952 | Stevenson | 217/42 |
| 3,341,064 | 9/1967 | Ricci | 217/42 |
| 4,176,745 | 12/1979 | Stollberg | 217/42 |
| 4,673,087 | 6/1987 | Webb | 206/600 |

FOREIGN PATENT DOCUMENTS

| | | | |
|---|---|---|---|
| 3545918 | 8/1986 | Fed. Rep. of Germany | 206/386 |
| 2629055 | 9/1989 | France | 206/386 |
| 7602245 | 9/1977 | Netherlands | 206/386 |
| 0631388 | 11/1978 | U.S.S.R. | 206/386 |
| 1474030 | 4/1989 | U.S.S.R. | 220/913 |
| 2128591 | 5/1984 | United Kingdom | 206/503 |

*Primary Examiner*—Paul T. Sewell

*Assistant Examiner*—Thomas P. Hilliard

[57] ABSTRACT

A totally integrated and vertically ducted refrigerated product transporter comprising a combination of assembable containers and a base. Due to its ducted and diffuser configuration, the transporter is intended to maximize air flow in the shipping and processing of bananas and other perishable items. It will also facilitate processing the product directly on the base without the need for restacking boxes or for special pressurized rooms. Each container is assembled/disassembled by manually sliding ten interchangeable pieces together. The container is fully assembled and interlocked when the top piece is inserted. Assembled, each container forms a segment of duct with its top/bottom acting as diffusers to regulate air flow and to interconnect each succeeding container to form a ducted column of containers. The base supports multiple ducted columns and also interconnects with them to maintain the integrity of the transporter as a ducted unit. The base completes the full extension of the duct by channeling the air flow from the ducted columns along its ducted interior and out the front or back depending on the position of the refrigeration equipment. Air flow through the ducted transporter is possible either from top-bottom as described above or from a bottom-top supply air delivery system.

1 Claim, 7 Drawing Sheets

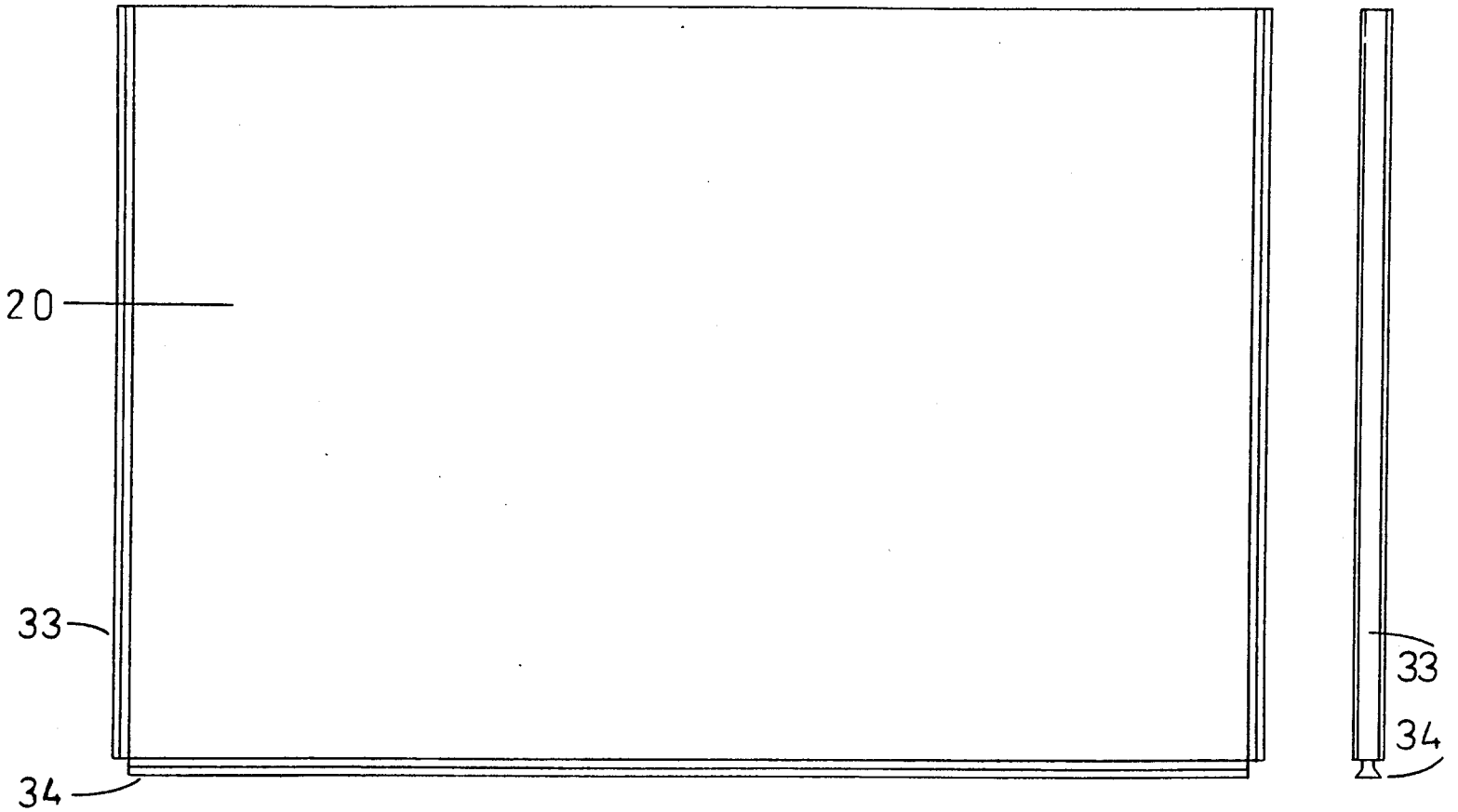
FIG. 6B
FIG. 6
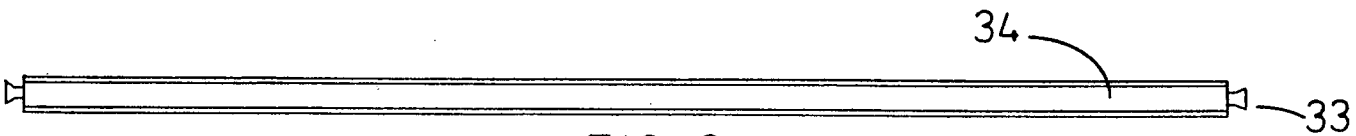
FIG. 6A

REFRIGERATED PRODUCT TRANSPORTER DUCT

TECHNICAL FIELD

The present invention relates to a transportation structure comprised of individualized containers and a platform which, when fully assembled, is designed to maximize air flow with a ducted configuration and is easily disassembled for storage and return.

BACKGROUND OF THE INVENTION

Transportation of products such as bananas originally was carried out by simply hanging the stems on a ships hold. This method led to tremendous losses as the product would most likely rot before reaching market. As a result, eating a banana during these times was considered a luxury. The advent of refrigerated holds on ships, refrigerated containers, fiberboard boxes and pallets, greatly reduced these losses and greatly expanded market potentials. No longer does the product require short delivery timetables, but they can be prolonged to as much as two to three weeks, thereby making it possible to reach markets as distant from the tropics as Europe.

Refrigeration plays the dominant role in the transportation of perishable goods. As in the case of bananas, for example, when the fruit is harvested it is immediately prepared for shipment by cutting into hands (that is the small clusters which ultimately reach your supermarket). These hands are then washed, disinfected, and placed into fiberboard boxes. These boxes are either directly loaded into refrigerated containers which are then placed on container vessels or on pallets which are hoisted into refrigerated ship bulks. The trend is leaning towards placing boxes on pallets even in refrigerated containers. After a succesful ocean voyage the bulk fruit is usually temporarily held at a refrigerated port warehouse facilty until delivery to wholesalers is made. The containerized units are also held at the port yards until delivery to wholesalers. Wholesaler facilities include specially built ripening rooms where the fruit is prepared for retail delivery. This is the main reason bananas are always waiting for us to eat and at such a reasonable price.

Refrigeration is the control of a given enviroment to maintain a product at preset conditions. These conditions are usually temperature and humidity. To achieve these conditions the most important factor is heat exchange, as is the case when cool air is circulated through a product. In order for cool air to circulate properly it must follow a path of least resistance, just like water passes in a pipe so should air be directed through a duct. Thus it is possible to maximize the efficiency of a refrigeration system.

The problem in todays' practice of refrigerating fresh fruits, such as bananas and other products, lies not in the refrigeration equipment, which generally is much more than adequate to handle any load, but in the distribution of air. The great majority of product losses in these industries is due to a major flaw in the packaging of these products for transportation and delivery. Packaging is not designed with air flow as a predominant consideration.

The onset of fiberboard boxes and wooden pallets to the fresh fruit industries was a great improvement (in its time), in that it facilitated the packaging, storage and distribution of these products. These boxes and pallets, in effect, are very inexpensive and do provide adequate protection to make them practical for these applications. Fiberboard boxes and pallets do not provide adequate ventilation for refrigeration purposes. The combination of boxes that are not designed to facilitate the flow of air and compounding the problem with pallets which further block the flow, creates astronomical losses. These losses are as follows:

product losses as much as 5–10% energy consumption wasted 10–30%

The low cost of fiberboard boxes (which are discarded after one trip), the low cost of wooden pallets and the relative affordability of energy has for too long now blanketed the need of incorporating a new packaging design. Today and tomorrow things require change! No longer can we continue to exhaust the forests to make fiberboard boxes and wooden pallets, nor to maintain expensive energy consuming equipment at inefficient levels.

Thus the object of this invention is to provide a system that will replace the fiberboard box and pallet as we know them today, with a system that will not only improve the survivability of the product but at the same time be capable of reducing energy costs and have a positive enviromental impact.

BRIEF DISCLOSURE OF THE INVENTION

The following invention provides a new approach to packaging and transporting refrigerated products, in particular fresh fruits.

This invention comes about as a direct result of a need to provide a more efficient and durable system for packing and transporting refrigerated products.

It rests on the principle of directing refrigerated air flow through a duct. It will also utilize state of the art plastic as the component material, which will maximize durability, strength and weight.

The invention is, in effect, very simple. It complies with the industry standard for the transportation of refrigerated products using individual boxes (e.g. fiberboard boxes) stacked on pallets.

Fiberboard boxes and pallets, as presently used, are not designed with air flow in mind. In fact, they hinder whatever flow there is.

The most important object of this invention is to provide an integral unit including boxes and pallet, which is designed to maximize air flow.

Another object is to provide a structure which is reusable, durable and easy to disassemble/assemble for compactness of storage and return transportation (fiberboard boxes are discarded after one trip and wooden pallets, which break easily, need to be constantly replaced).

Maximum air flow is attained by designing the entire system as if it were a duct. The top and bottom of each box consists of identical structures whose function is to serve as diffusers (they also physically lock one level with the next to prevent slipping and sliding during transportation). The box diffusers all stack up vertically on top of the transporter pallet whose base is also a diffuser and also interlocks the boxes in place. The 4 sides of every box are solid so that air is channeled vertically from the top diffusers and out through the bottom of the pallet diffuser or visa versa (this is the standard supply/return air flow arrangements on all existing refrigeration equipment).

Fiberboard boxes' tops and bottoms have too small and concentrated an open area to provide sufficient and uniform air distribution. Also the fiberboard boxes' sides have open handles and slots so that not only is there insufficient air flow through the product but what air does get through is lost through the handles and slots. To top it all off, the wooden pallets obstruct the air flow even further. No matter how good the refrigerating equipment, it is useless unless there is adequate air flow, which can only be attained through proper design.

Aside from air flow, fiberboard boxes easily crush as they absorb moisture and especially when wet by rain. Moisture laden boxes will also chill the product due to the evaporating effects on its surface. Thus, these are some of the very important reasons for changing to the new boxes.

This invention will provide a durable plastic transporter pallet and reusable plastic boxes which are easily disassembled/assembled. A pallet with 48 boxes, 8 levels high will be reduced to 8 boxes, 2 levels high. This produces a compact structure for storage and return transportation. The box components are manufactured so that assembly/disassembly requires nothing more than sliding 10 pieces together to form a box (no fasteners are required as the box is firmly held together utilizing the elastic properties of the plastic).

The entire unit is designed to prevent slipping and sliding during transportation by interlocking mirror image feet on the diffusers.

BRIEF DESCRIPTION OF THE DRAWINGS

FIG. 6 is a top view of transporter box long side panel, showing length by height, and bottom and side dovetail rails.

FIG. 6*a* is a side view of long side panel lenght, showing bottom and side dovetail rails.

FIG. 6*b* is a side view of long side panel height, showing bottom and side dovetail rails.

DETAILED DESCRIPTION OF DRAWINGS

Note: All materials for transporter will be selected plastics depending on weight, strenght, durability and cost considerations).

Figure 1:
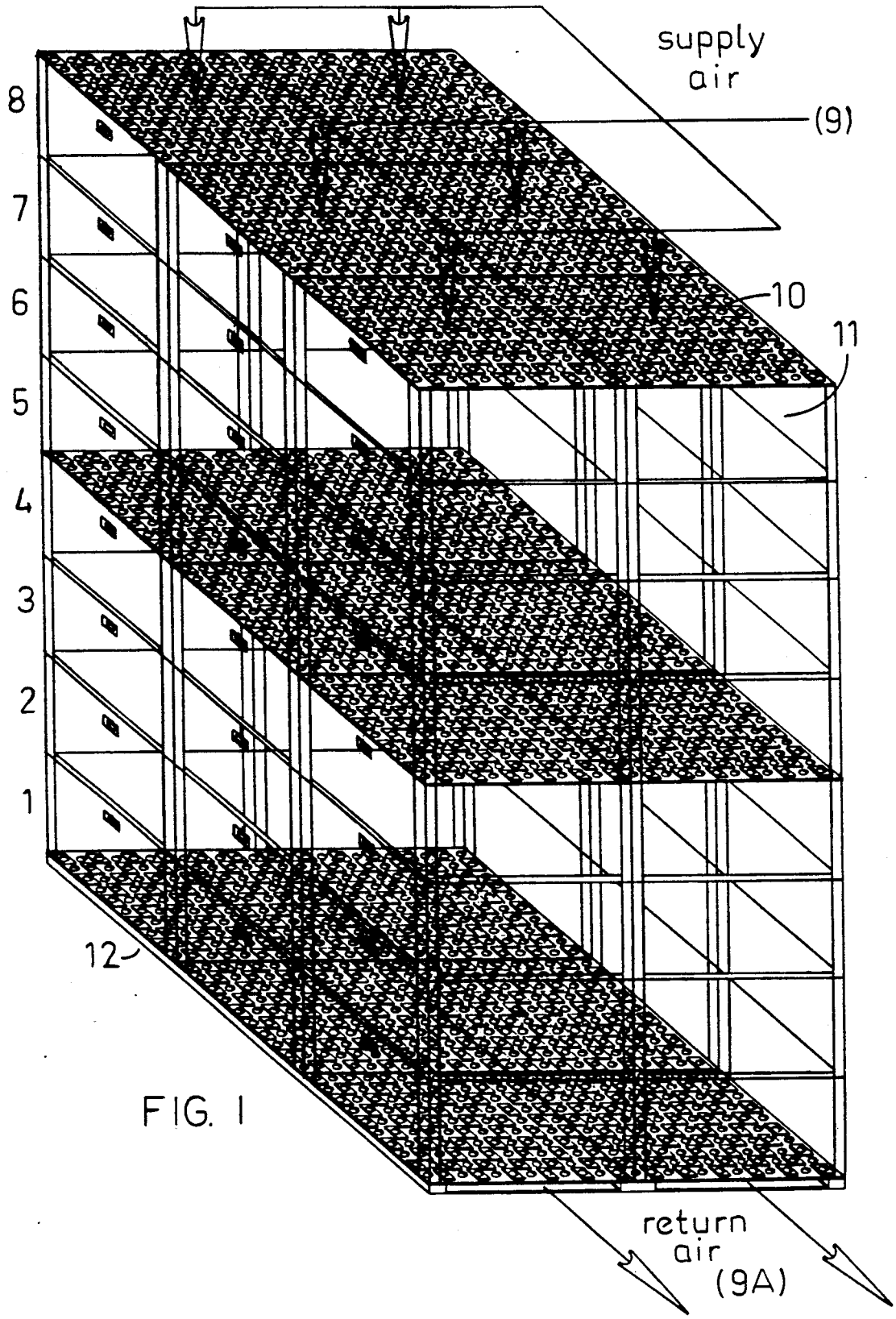
FIG. 1 is a perspective view showing a fully assembled transporter, 8 levels high by 6 boxes for each level for a total of 48 boxes stacked on the transporter pallet. Diffusers are only shown at three levels instead of 8 levels) for clarity. Arrows denote air flow through transporter.

FIG. 1 is a perspective view of the ducted refrigerated product transporter. It consists of the fully assembled unit with all its components, as it will appear during transportation. #1–8 are the eight levels that are presently used for most configurations, with each level having identical diffusers #10 and consisting of 6 boxes per level #11, for a total of 48 boxes for this transporter (Configurations may vary). These boxes are stacked on the transporter pallet #12, whose dimensions are industry standard for use with forklifts The system as shown is presented to emphasize the new design for increased air flow through the transporter (arrows), #9 represents supply air and #9A return air (air flow may be reversed).

Figure 2:
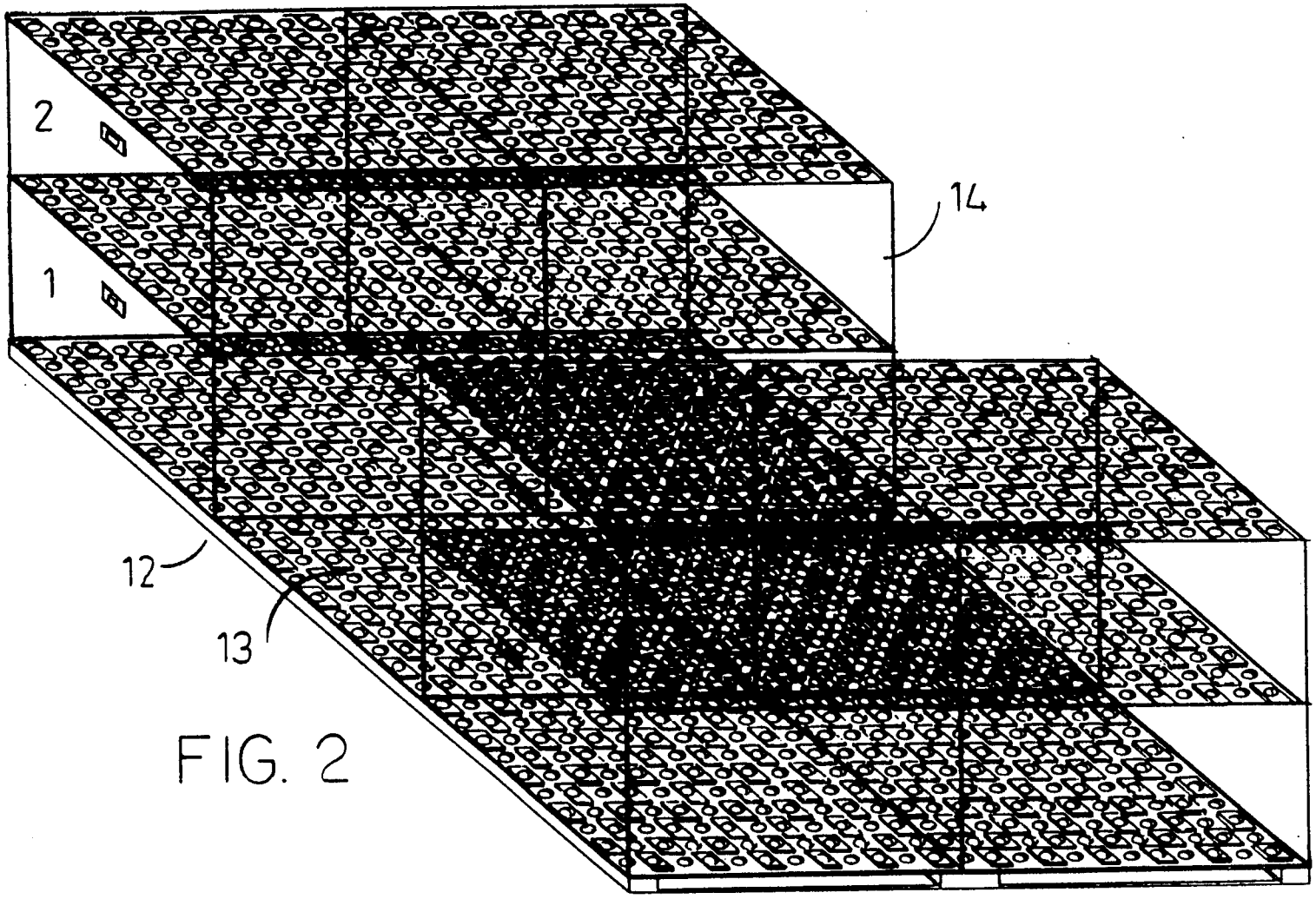
FIG. 2 is a perspective view showing how transporter appears when disassembled.

FIG. 2 is a perspective view of the disassembled ducted refrigerated product transporter, as it will appear when compacted for storage and return transportation. It will compact to a two level #1–2 structure, consisting of eight boxes #14 containing all side panels of the other 40 disassembled boxes, a center space #13 for top and bottom diffusers which don't fit inside boxes (top and bottom diffusers not shown) and the transporter pallet #12. Four of these disassembled units can be stacked as a single unit for storage and return. Thus the compactness rate is four fully assembled transporters, disassembled to the space of one (4:1).

Figure 3:
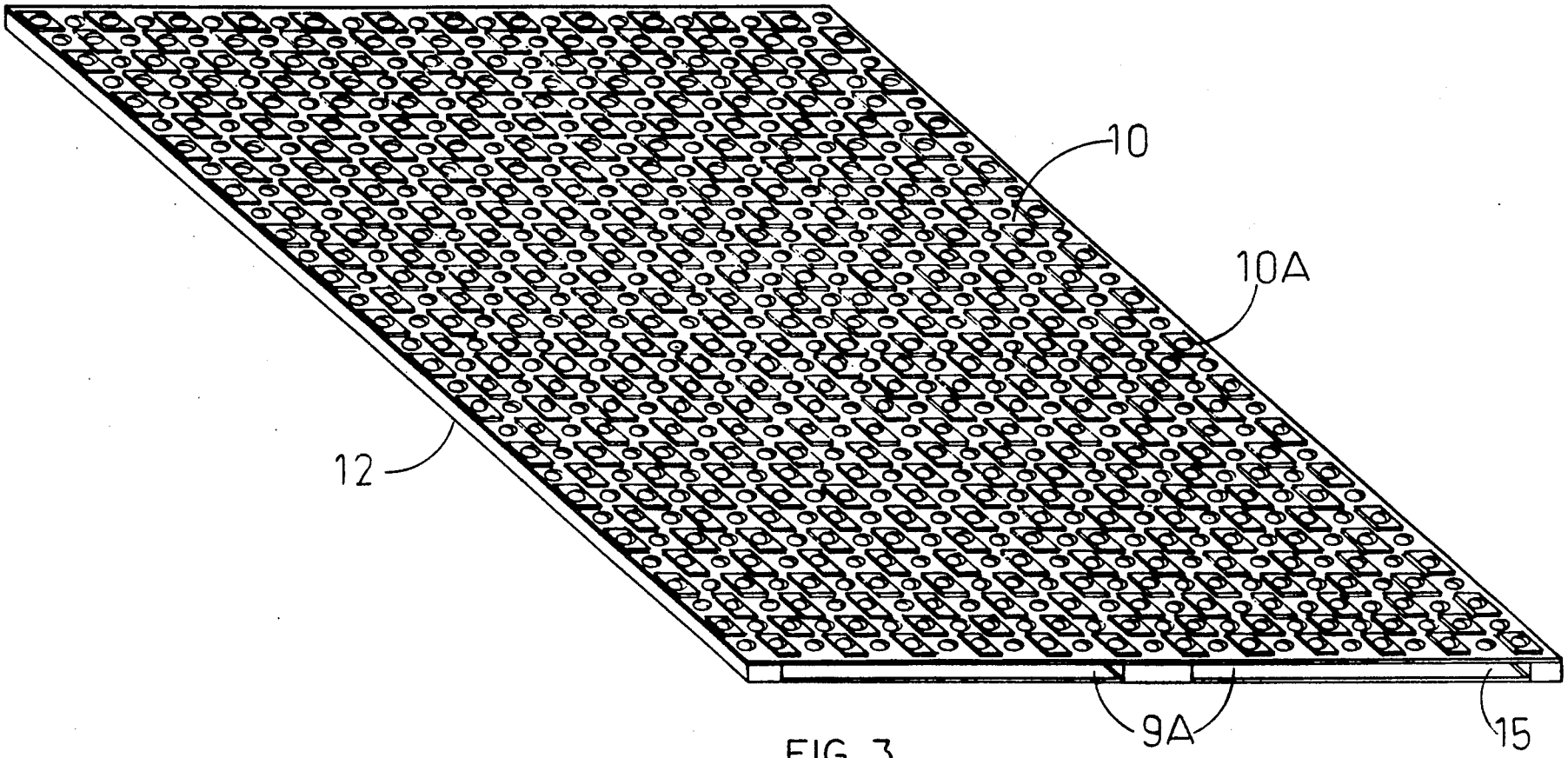
FIG. 3 is a perspective view of the transporter pallet.

FIG. 3 is a perspective view of the transporter pallet #12.

The transporter pallet is designed as a standard size pallet with entry for forklifts at #15, but also it will serve as a diffuser #10, which will facilitate air flow by lining up vertically with all box diffusers and by allowing return air through #9A (may be used as supply air in opposing air flow). #10A depicts interlocking feet which will prevent boxes from slipping and sliding during transportation.

Figures 4, 4A, 4B:
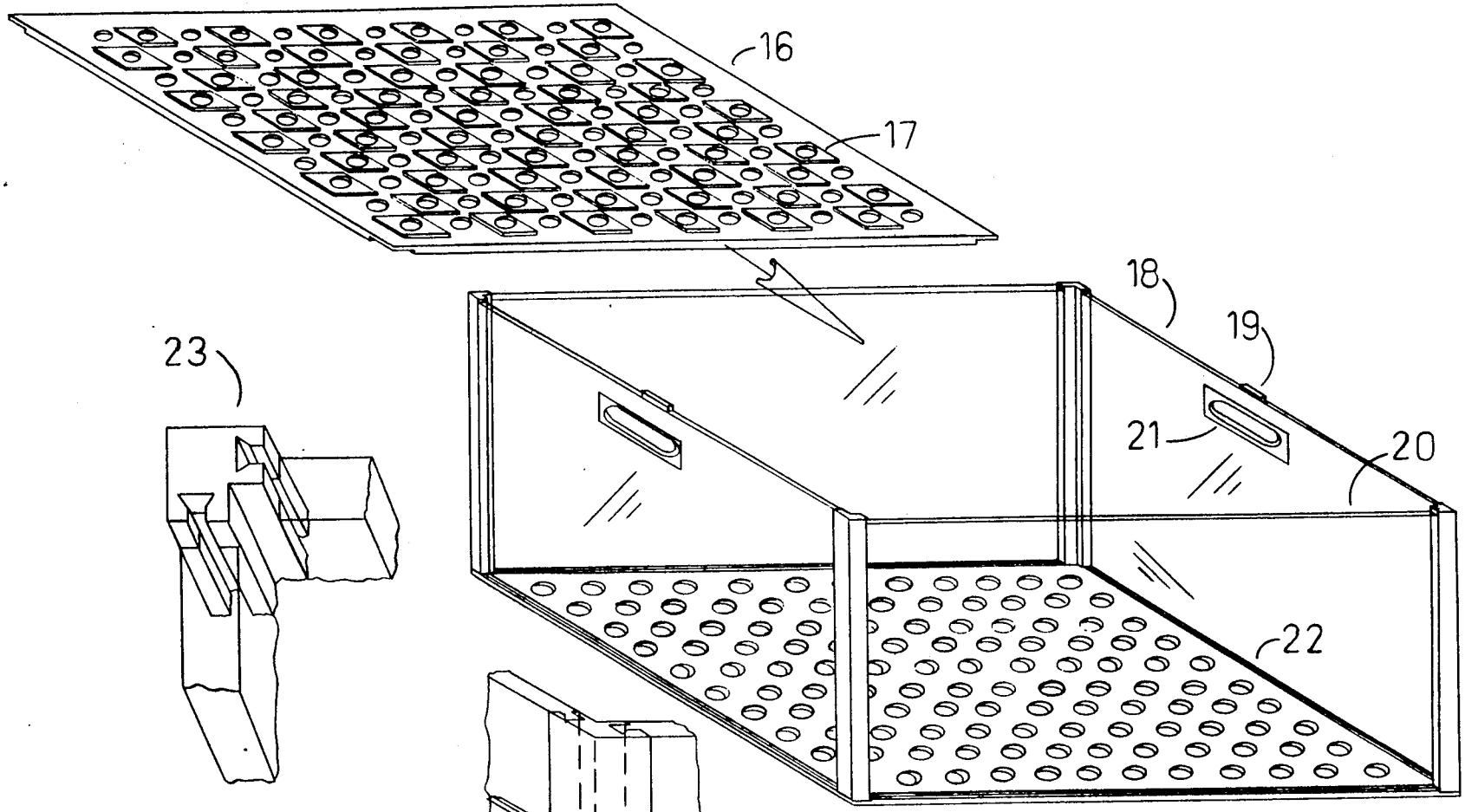
FIG. 4 is a perspective view of the transporter box. At this stage the box is assembled except for the top, which will slide into position (direction of the arrow).
FIG. 4*a* is a perspective detail of a corner post.
FIG. 4*b* is a perspective view of how a corner post will be seated on a bottom diffuser and inversely on a top diffuser.

FIG. 4 is a perspective view of a transporter box. The box consists of ten pieces, which are designed for easy assembly/disassembly by sliding on one another. Assembly is accomplished as follows:

a) #22 bottom diffuser (identical to #16 top diffuser), is placed flat with interlocking feet #17 facing down and dovetail tracks facing up. Interlocking feet are designed so that top diffusers and bottom diffusers will interlock boxes vertically to prevent slipping and sliding during transportation.

b) #20 long side panels (one on each side), slide into long side dovetail tracks of bottom diffuser.

c) #18 short side panels (one on each side), slide into short side dovetail tracks of bottom diffuser. (Short side panels each have a self sealing handle opening #21, whose purpose is to handle the boxes and to prevent air from escaping through sides).

d) #23 corner posts (total of four, with one for each corner) slide vertically down on each corner to lock all four side panels in place. Corner posts are 'L' shaped with perpendicular dovetail tracks along entire height. FIG. 4A shows a corner post holding together two sides in place. FIG. 4B shows how the corner posts will be seated on bottom diffuser (this seating is inversely identical for top diffuser, which locks box together in next step).

e) #16 top diffuser (identical to #22 bottom diffuser), slides with interlocking feet #17 facing up and dovetail tracks facing down, on dovetail rail #19. Top diffuser seats on all four corners with arrangement as shown inversely in FIG. 4B.

Figure 5A:
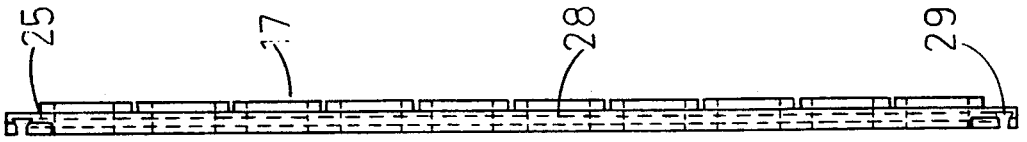
FIG. 5 is a top view of box diffuser (top & bottom identical) showing diffuser holes, interlocking feet (dashed lines), corner seats, and dovetail tracks.
FIG. 5*b* is a side view of box diffuser width showing dovetail tracks, interlocking feet and corner seats.
Figure 5:
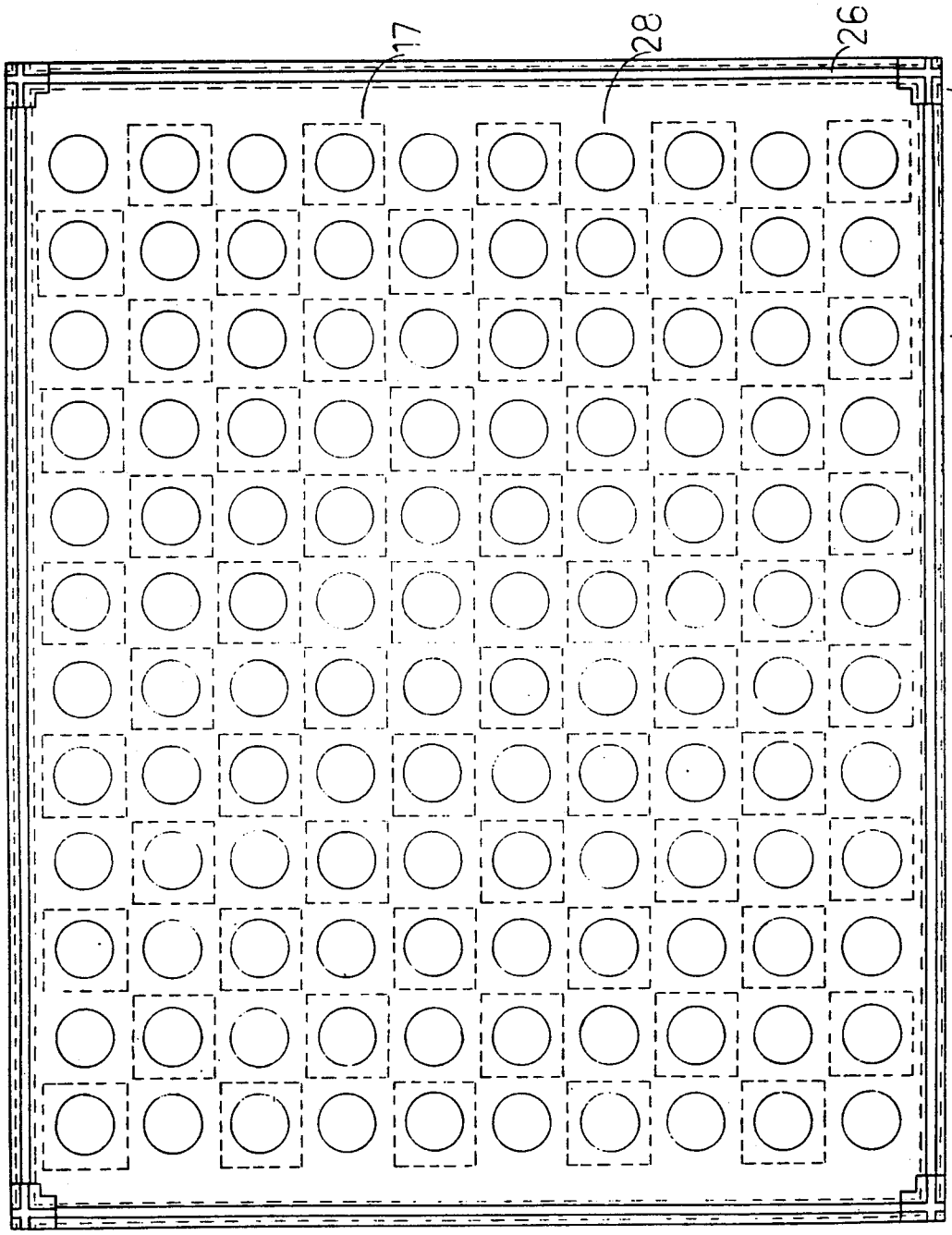

FIG. 5 is a top view of a box diffuser (#22 & #16) lying flat as it appears in assembly instruction of FIG. 4 step a. Maximum and uniform air flow distribution is achieved through the circular openings #28. These openings are symmetrically designed so that they line up throughout assembled transporter. Dovetail tracks #29 (long side) and #26 (short side), are cut out along entire lengths and widths of diffuser, these tracks are where the four side panels slide in for assembly. The four side panels are secured vertically with 4 corner posts that rest on four corner seats #25 for bottom diffuser. Inversely, these corner seats lock and seat top diffuser as last step in box assembly (see instruction of FIG. 4 step e). Interlocking feet #17 are shown as boxed dash lines.

FIG. 5B is a side view of the box diffuser width. It shows dovetail track openings #29, where long side panels will slide into. Interlocking feet #17 are shown protruding at bottom. Circular openings #28 are represented by dashed lines across entire thickness. Corner seats #25 are shown at each corner, but are better portrayed in FIG. 4B.

FIG. 6 is a top view of a diffuser box long side panel #20 (two per box). It shows two dovetail rails #33, one on each side along height and one dovetail rail #34 along bottom. Dovetail rails along height will accept corner posts and dovetail rail along bottom will slide on bottom diffuser lenght.

FIG. 6A is a side view of bottom of long side panel showing bottom dovetail rail #34 and the two height dovetail rails #33, one on each side.

FIG. 6B is a side view of height of long side panel showing bottom dovetail rail #34 (note there is no rail on top, along which top diffuser will rest).

Figure 7B:
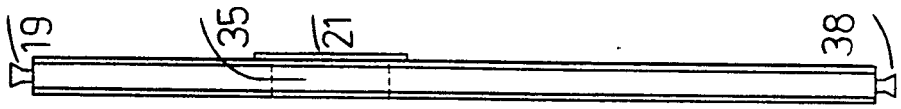
FIG. 7*b* is a side view of short side panel height, showing self sealing handle opening, and side and top dovetail rails.
Figure 7:
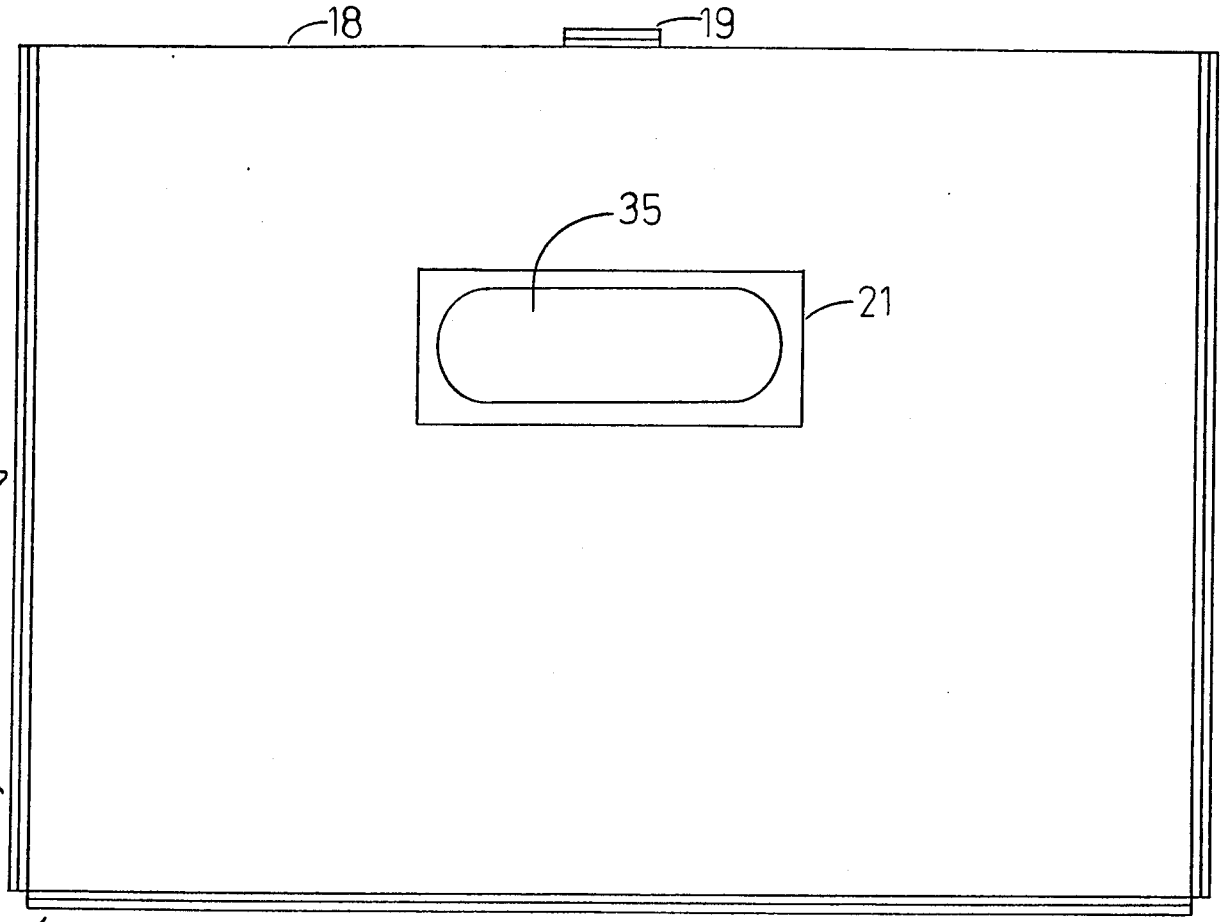
FIG. 7 is a top view of transporter box short side panel, showing width by height, self sealing handle opening, and top, bottom and side dovetail rails.

FIG. 7 is a top view of a diffuser box short side panel #18 (two per box). It shows a top dovetail rail #19 along which top diffuser will slide. The bottom dovetail rail #38 slides along bottom diffuser width, while the height dovetail rails #37 will accept corner posts. The self sealing handle opening consists of the opening #35 and an elastic flap #21 which bends to open and closes to seal (flap will be positioned always on inside of box).

Figure 7A:
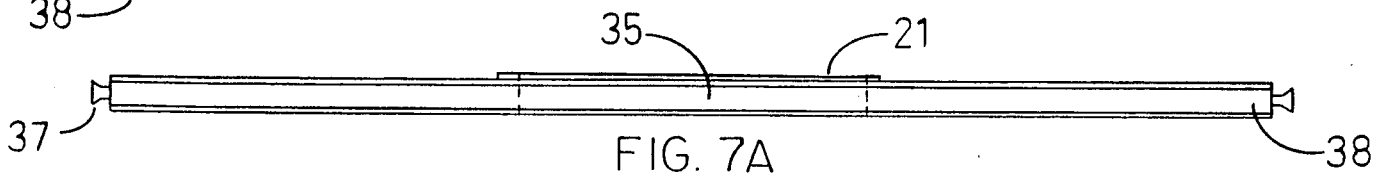
FIG. 7*a* is a side view of short side panel width, showing self sealing handle opening, self sealing handle opening and bottom and side dovetail rails.

FIG. 7A is a side view of short side panel showing elastic flap #21, handle opening #35 across entire thickness indicated by dashed lines, dovetail rail across bottom #38 and side dovetail rails #37 on sides.

FIG. 7B is a side view of short side panel showing top dovetail rail #19, elastic flap #21, dashed lines representing handle opening #35, height dovetail rail #37 and bottom dovetail rail #38.

While the preferred embodiment of the present invention has been disclosed in detail, it is to be understood that various modifications in its structure may be adopted without departing from the spirit of the invention or the scope of the following claims.

I claim:

1. A transporter for the shipping and processing of perishable items comprising:

a generally rectangular and relatively flat base; the base including a base diffuser plate having a plurality of apertures therethrough, a top side of the base diffuser plate having interlocking means, a bottom side of the base diffuser plate having a plurality of support member parallel to the longitudinal axis such that channels for air are formed allowing air to vent outside the base when the support members are placed on a flat resting surface;

a plurality of containers able to be stacked one on top of another and on top of the base; each container comprising identical top and bottom diffuser plates each having a plurality of apertures therethrough, each diffuser plate having a plurality of sides, one of the diffuser plate sides having interlocking means capable of being mated with another diffuser plate, an opposite diffuser plate side having multiple tracks around the perimeter;

a plurality of identical corner posts with L-shaped cross-sections, having a plurality of longitudinal tracks;

a plurality of identical longitudinal side walls each having rails formed on the perimeter to slidingly interconnect with the tracks of the diffuser plates and the tracks of the corner posts to form a vertically standing structure;

a plurality of identical shorter side walls each having rails formed on the perimeter to slidingly interconnect with the tracks of the diffuser plates and the tracks of the corner posts to form a vertically standing structure, the shorter side walls also having at least one handle aperture with self sealing means;

whereas when the containers are stacked on the base a transporter is formed with an air permeable top, an air permeable base and air impermeable sides such that the transporter acts as a continuous air duct between an uppermost container diffuser plate and the base air channels.

* * * * *